US009903312B1

(12) United States Patent
Walsh

(10) Patent No.: US 9,903,312 B1
(45) Date of Patent: Feb. 27, 2018

(54) RADIAL CRANK EXTERNAL HEATED ENGINE

(71) Applicant: Beau Alfred Walsh, Vancouver, WA (US)

(72) Inventor: Beau Alfred Walsh, Vancouver, WA (US)

( * ) Notice: Subject to any disclaimer, the term of this patent is extended or adjusted under 35 U.S.C. 154(b) by 0 days.

(21) Appl. No.: 15/376,024

(22) Filed: Dec. 12, 2016

(51) Int. Cl.

| | |
|---|---|
| ***F02G 1/044*** | (2006.01) |
| ***F02G 1/055*** | (2006.01) |
| ***F02G 1/053*** | (2006.01) |
| ***F02G 1/045*** | (2006.01) |
| ***F01L 7/14*** | (2006.01) |
| ***F01B 9/02*** | (2006.01) |
| ***F01B 31/28*** | (2006.01) |

(52) U.S. Cl.
CPC ..... *F02G 1/044* (2013.01); *F01B 9/02* (2013.01); *F01B 31/28* (2013.01); *F01L 7/14* (2013.01); *F02G 1/045* (2013.01); *F02G 1/055* (2013.01); *F02G 1/0535* (2013.01)

(58) Field of Classification Search
CPC ..... F02G 1/044; F02G 1/045; F02G 1/0535; F02G 1/055; F01B 9/02; F01B 31/28; F01L 7/14
USPC ..... 60/643
See application file for complete search history.

(56) References Cited

U.S. PATENT DOCUMENTS

| | | | | |
|---|---|---|---|---|
| 2,787,993 | A * | 4/1957 | Tacconi | F01L 7/08 123/190.9 |
| 3,198,181 | A * | 8/1965 | Dolphin | F01L 7/08 123/190.9 |
| 5,228,294 | A * | 7/1993 | Murray | F01B 13/061 60/709 |
| 5,343,832 | A * | 9/1994 | Murray | F01B 1/0655 123/44 B |
| 2013/0118445 | A1* | 5/2013 | Doyle | F01B 13/061 123/200 |
| 2013/0233259 | A1* | 9/2013 | Courson | F01L 7/021 123/54.3 |

* cited by examiner

*Primary Examiner* — Patrick Maines

(57) ABSTRACT

A radial crank external heated engine having multiple alignments of pistons radial to multiple collinear rotary valves, multiple crankshafts connected to alignments of pistons, and a common output shaft connected to the crankshafts. A heat conductive working fluid is cycled to the engine from a heat producing external energy source via a slotted channelled tube extended centrally through the rotary valves. The rotary valves have intake and exhaust sections that communicate with the channelled tube and provide means working fluid exchange with respective pistons at timed intervals. The pistons are reciprocally driven by the entry of pressurized work fluid in the cylinder, and the resulting motive power is transferred along the crankshafts to the output shaft where it can be harnessed.

5 Claims, 8 Drawing Sheets

RADIAL CRANK EXTERNAL HEATED ENGINE

BACKGROUND OF THE INVENTION

Field of Invention

The present invention relates to reciprocating external heated engines, specifically to a radial crank external heated engine which produces usable motive power when supplied energy by the means of a heat conductive single-phase or dual-phase working fluid from an adapted heat producing external energy source.

Description of Prior Art

In an external heated engine, thermal energy is converted to mechanical energy by the means of a working fluid that is cycled to perform in a working body. The working fluid may be single-phase (such as a gas) or multi-phase (such as liquid to gas; steam) and receives energy from an external energy source, which be of any type that produces heat, practically of a combustion, nuclear, or renewable type. As such, external heated engines are advantageous to internal combustion engines in many ways, for example, they do not necessarily require a burnable substance to function, which is both versatile and potentially environmentally friendly if the alternative method of heat production is a renewable source. This may be especially favorable aboard heavy fuel oil freighters in large ports where pollution is abundant. However, external heated engines are typically large and complex, which increase purchasing and repair costs, and typically restricts modern use to a single mode of use in a decreasing amount of ships on the ocean.

US Pat. No. 20120073296 of Michael W. Courson describes a rotary cam steam engine of a compact design where multiple pistons having affixed rollers sit in cylinders radial to a single central rotary valve and reciprocate against a sinusoidal cam ring which rotates an attached shaft. The rotary valve has an upper chamber and a lower chamber with orifices that manage intake and exhaust of working fluid between a steam chest area and the cylinders, and valve ports banded with the orifices that selectively align with valves along the inner circumference of the engine assembly to exchange working fluid with an external source.

This is the most recent design of an existing concept, in which a cam is driven by pistons innerly affixed to a rotary valve assembly. But this design, and indeed concept, have many complexities that make application impractical. Only one rotary valve is present as multiple cams having rotatory offets to balance the intertia of pistons along multiple rotary valves would be geometrically incompatible with each other. This limitation tethers cumulative working body displacement to the size of the single rotary valve that can supply it and proportionally the size of the engine. Another unfavorable trait of this engine relates to the pistons, the pistons rely on the input of a working fluid to maintain rolling engagement with the cam, which is problematic when the rotary valve cuts supply of working fluid to the pistons in order to decelerate the engine as engagement may cease. Yet another unfavorable trait of this engine relates to the rotary valve, circumferential valve ports on the rotary valve must align with valves on the engine assembly between cylinders, this valve mechanic reduces the number of pistons that can be paired to the rotary valve as more spacing is required between.

The invention disclosed herein, namely the Radial Crank External Heated Engine, aims to counter the drawbacks of mobile external heated engines by furthering the inherent efficiency of an external heated engine while simultaneously reducing manufacturing costs corresponding with price and creating a more streamlined functional design to reduce potential of failure that is equated to maintenance costs. Efficiency is maximized in many ways, including, reducing the flow length of fluids communicated between the engine and the external source to reduce heat loss, increasing power production the given volume of fluid provided through a complex array of tightly displaced pistons that share inertia on common shafts, and reducing the weight and size of the engine to maximize the power produced and the applications of use that may be considered. Manufacturing benefits from the aforementioned reduction of weight and size because less material resources and time are required to construct the engine and less bulky periphery systems are needed to support engine function. These effects further benefit the buyers in multiple industries as the lower load bearing components of a smaller engine require less overall maintenance.

BRIEF SUMMARY OF INVENTION

The present invention is directed to a machine and apparatus of an external heated piston engine having a plurality of rotary valves linearly arranged, in which each rotary valve is responsible for intake and exhaust of working fluid, a plurality of pistons radially disposed to each rotary valve, the pistons being radially aligned between rotary valves, a cylinder encasing each piston, the cylinders forming banks between radially aligned pistons, a plurality of crankshafts, each crankshaft parallel to each cylinder bank and mated to the respective pistons within, and a housing to seat and encase working components; as well as, a pipe to convey fluids to and from the engine, which is extended axially through a central portion of all the rotary valves and features intake and exhaust channels with respective outlets and inlets corresponding to the internal intake and exhaust sections of the rotary valves.

Among the possibilities to be contemplated, the present invention may further include: having an engine output shaft to which the crankshafts merge motive power, having a pulley system to transmit motive power between the crankshafts and output shaft, having the pipe fixed and not attached to the rotary valves or having the pipe rotatable and attached to the rotary valves, having the pipe provide pivotal support for the movement of the rotary valves, having the rotary valves linked as one unit which receives motive power from the output shaft, having rotatory offsets between the rotary valves corresponding with the crank journal layout and piston movement of the crankshafts, having a timing relationship between the rotary valves and the crankshafts that may be fixed or variable, and having cooling means, lubrication means, and sealing means to support working components in the engine.

DETAILED DESCRIPTION OF THE DRAWINGS

Figure 1:
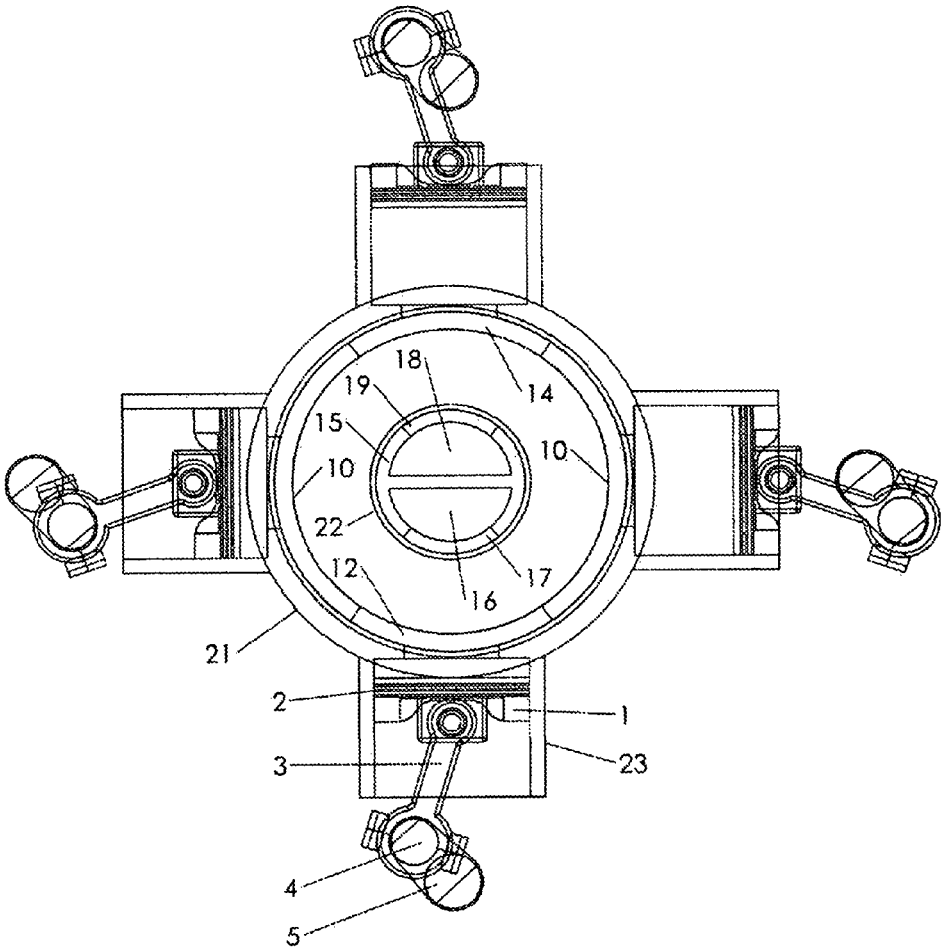
FIG. 1 is a frontal view of a single rotary valve subassembly with the inner workings exposed by wire-frame.
Figure 2:
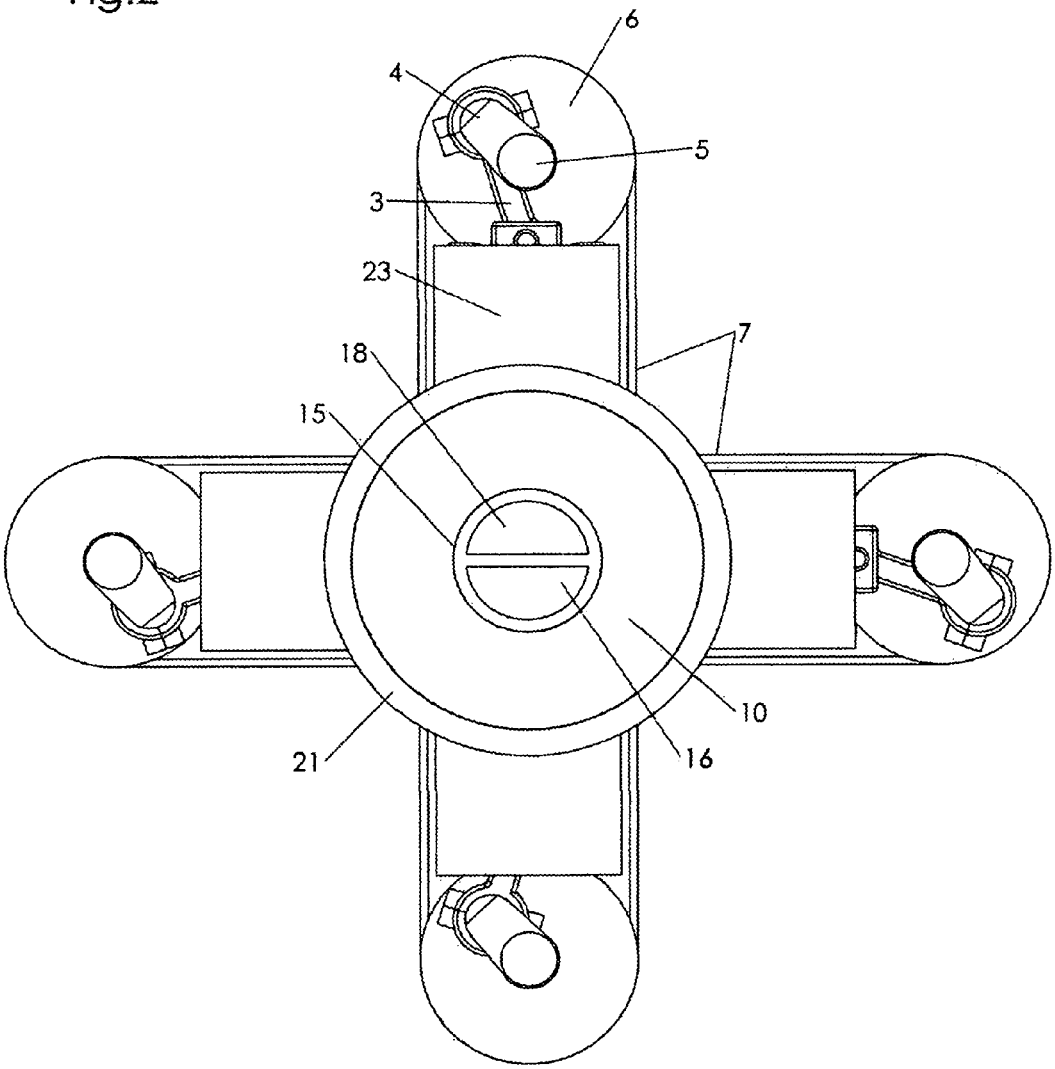
FIG. 2 is a standard frontal view of a single rotary valve subassembly showing the housing body partially shrouding the inner workings.

Referring to FIG. 1-FIG. 2, a rotary valve subassembly is shown in which a plurality of pistons 1 are radially disposed to a respective rotary valve 10. The pistons 1 and rotary valves 10 exchange a working fluid that drives the pistons 1 at optimally timed intervals. Timing is primarily dependent on rotary valve 10 movement and powering the rotary valves 10 may be performed by the engine internally via power communicated indirectly from the pistons 1, but other means may be contemplated. The pistons 1 are seated in cylinders 23 having minimal circumferential wall clearance and include piston rings 2 fitted in grooves along the circumference of the piston head to prevent working fluids from exiting the piston chamber or oil from the housing body 21 entering the piston chamber. The housing body 21 encloses the cylinders 23, the rotary valves 10, the crankshafts 5, and further extends to enclose peripheral working components as needed in application (illustrated partially to expose internal function of the piston and crankshaft workings). The pistons 1 have connecting rods 3 that are attached to the crankpin journals 4 of radially aligned crankshafts 5, the crankshafts 5 rotating in response to reciprocation of the pistons 1 through the connecting rods 3. The crankshafts 5 include crankpin journal offsets and weighting to balance half and first order vibrations and may include further balancing means to balance second and higher if applicable. The rotary valve 10 has any equal number of intake apertures 12 and exhaust apertures 14 axially pitched about approximately opposite sides of the rotary valve circumference relative to each other, there being one intake aperture and one exhaust aperture presently illustrated, and as the rotary valve 10 rotates, the intake aperture 12 and exhaust aperture 14 revolve circumferentially around the rotary valve axis to intersect with the respective quantity of cylinder ports of each cylinder 23 sequentially. The working fluid is pressurized and not combustable, conventionally a single-phase fluid, a gas, or a multi-phased fluid, which involves a matter phase change, especially between liquid and gas. The ideal working fluid would have inviscid and compressible or expandable properties. The working fluid increases pressure upon receiving heat from the external energy source and expands once in the piston chamber, driving the piston 1 and generating motive power, then recycles for reuse. The intake aperture 12 intakes a working fluid to each cylinder 23 and the exhaust aperture 14 exhausts working fluid from each cylinder 23. Referring to the illustrations, moving from the top clockwise, piston 1*a* is in upstroke and exhausting working fluid into the rotary valve 10 through the exhaust aperture 14, piston 1*b* is moving to bottom-dead-center position after intaking working fluid, piston 1*c* is in downstroke and intaking working fluid from the rotary valve 10 through the intake aperture 12, and piston 1*d* is moving to top-dead-center position after exhausting working fluid. At top and bottom-deadcenter positions, the pistons 1 ultimately lack leverage, that is compensated by the plane orientation of the crankshafts and the offsets between the crankshafts, as elaborated well below. If motive power generated by the pistons 1 on the crankshafts 5 rotates the rotary valves 10, the timing relationship between the rotary valves 10 and the crankshafts 5 may be variable or fixed by means.

Figure 3:
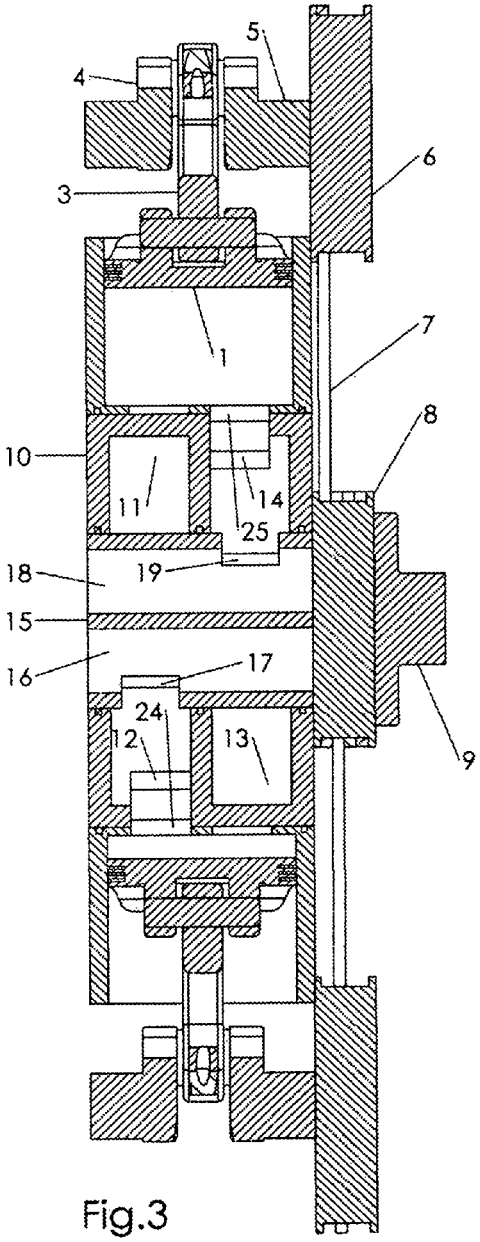
FIG. 3 is a side view of a single rotary valve subassembly sectioned mid-plane.
Figure 4:
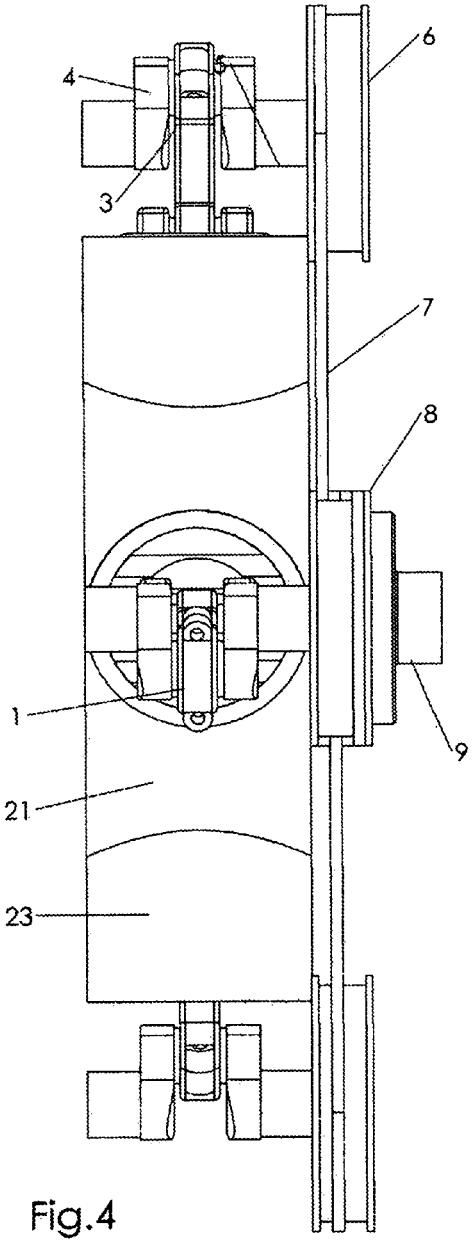
FIG. 4 is a standard side view of a single rotary valve subassembly with emphasis on the pulley mechanism.
Figure 5:
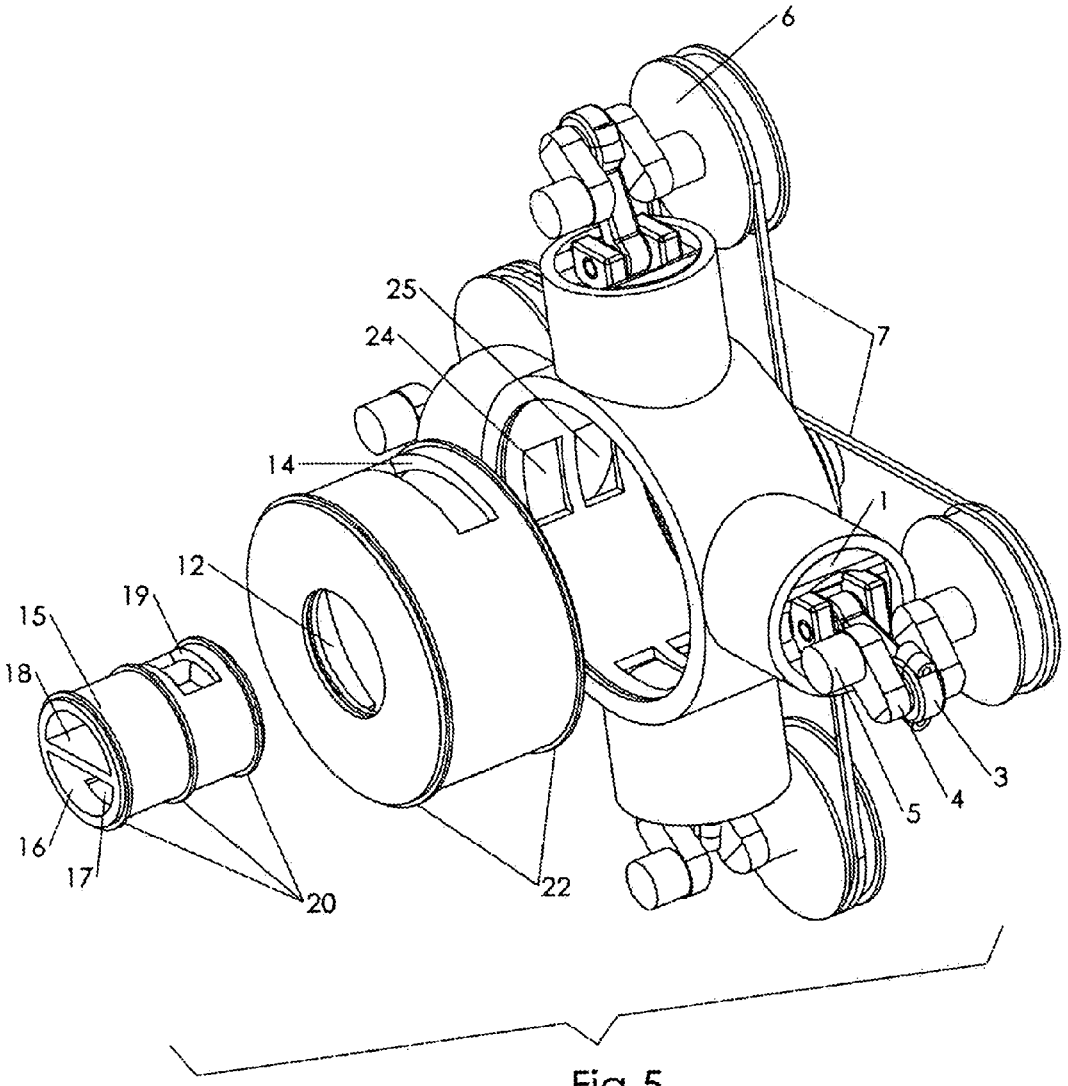
FIG. 5 is a dimetric view of a rotary valve subassembly with the rotary valve and slotted channelled tube exploded to expose the inner workings.
Figure 6:
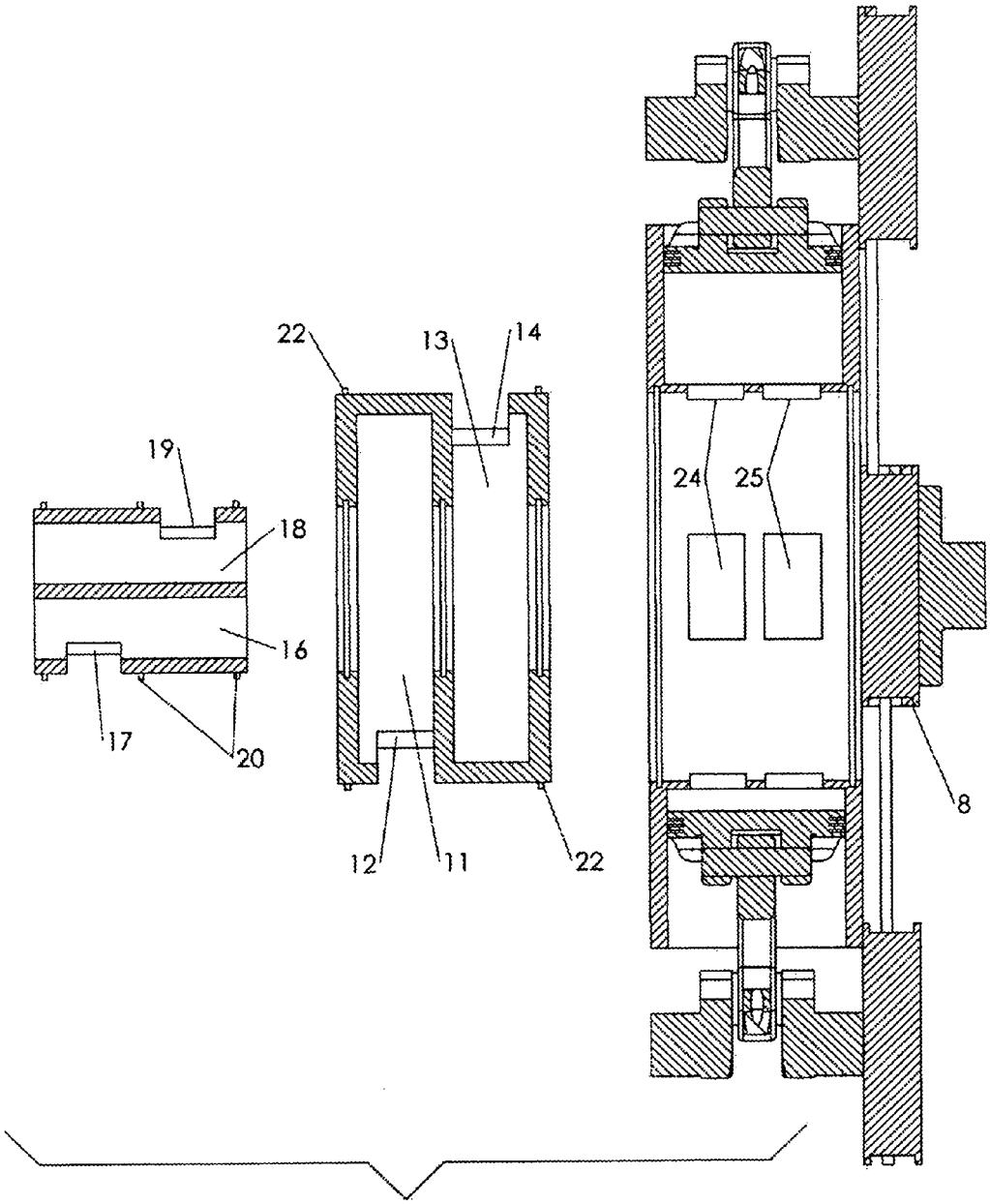
FIG. 6 is a side view of a rotary valve subassembly with the rotary valve and slotted channelled tube exploded and sectioned mid-plane to further express the inner workings.
Figure 7:
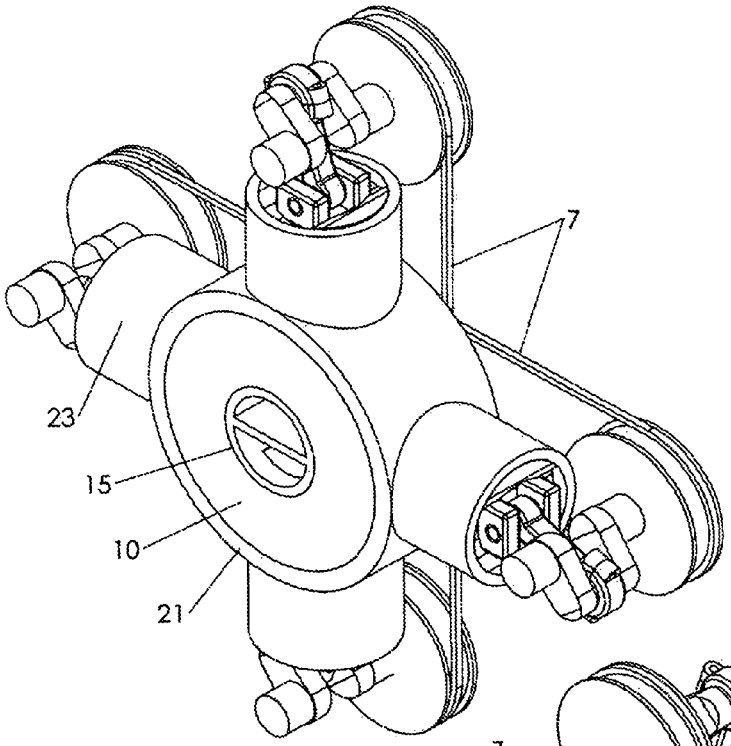
FIG. 7 is a front isometric view of a rotary valve subassembly.
Figure 8:
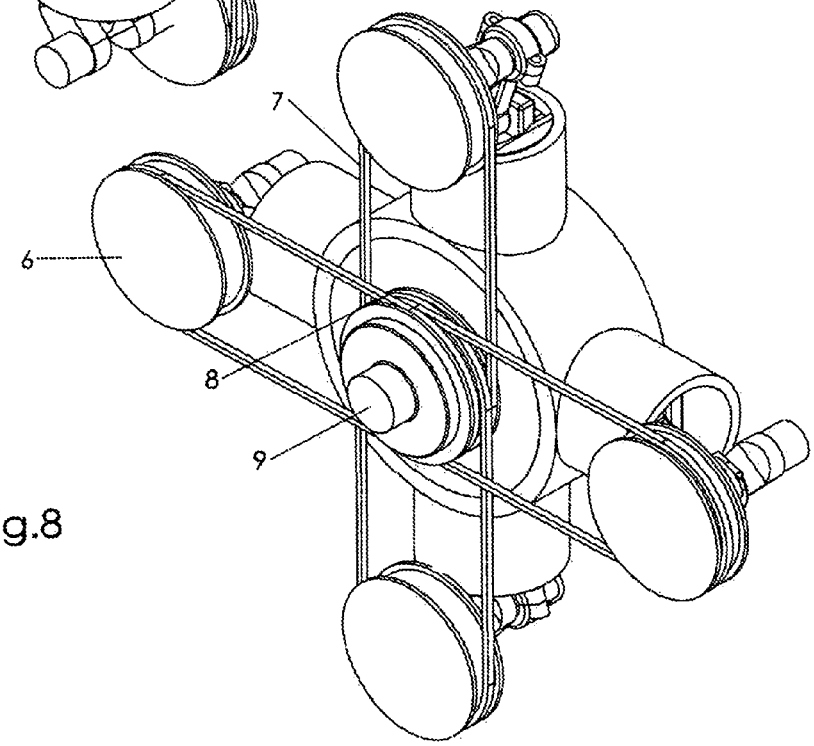
FIG. 8 is a rear isometric view of a rotary valve subassembly.

Referring to FIG. 3-FIG. 4, the rotary valve 10 is shown having an intake section 11 and an exhaust section 13, which are laterally divided about two segments of the length. The intake section 11 in the rotary valve 10 holds intake working fluids and the exhaust section 13 in the rotary valve 10 holds exhaust working fluids. Each section of the rotary valve is necessary for mediating fluids between the external energy source and the pistons, the intake section maintains a high volume of intake fluids to maintain a high pressure environment to motivate a piston at each interval, while the exhaust section allows for continuous scavenging of fluids during and between exhaust intervals to maintain a low pressure environment. Paired with the intake section 11 is an intake aperture 12, which intersects with a cylinder intake port 24 atop each cylinder 23 to allow working fluids into the piston chamber. Paired with the exhaust section is an exhaust aperture 14, which intersects by interval with a cylinder exhaust port 25 atop each cylinder 23 to allow working fluids out of the piston chamber. The cylinder ports have curvature identical relationships with the circumference of the rotary valves, which is ideal for fluid exchange between two boundaries. The rotary valves 10 may include more than one aperture per section if the sections are circular and divided about composing segments of the rotary valve length, each section having an equal quantity of apertures positioned oppositely of each other in relation to the timing. As stated, the sections of the rotary valve 10 are laterally divided about two segments of the rotary valve length, meaning they are separated by walls at defined points collinear along the axis. Conversely, the rotary valve 10 sections may be radially separated and divided parallel to the rotary valve axis with each section occupying limited range of degrees outward from the axis, the section walls having radial displacement round defining the sections, this may require only one port per cylinder 23 being dually responsible for intake and exhaust with the apertures all being in-line. A pipe 15 is extended axially through a central portion of all the rotary valves 10 and features at least one intake channel 16 and at least one exhaust channel 18, all of which occupy separate longitudinal portions of the pipe interior. The intake channel 16 has an open outlet 17 to the intake section 11 of each rotary valve 10 and the exhaust channel 18 has an open inlet 19 to the exhaust section 13 of each rotary valve 10. The rotary valves 10 rotate around the pipe 15 at the center and this allows continuous movement of the working fluid between the rotary valve sections and the respective pipe channels. Each channel has at least one end to which working fluid is communicated with an external energy source. The external energy source stated may be of any type, including a combustion, nuclear, or renewable type, to generate heat for circulating working fluid with the engine. The intake working fluid flows from the external energy source to the rotary valve 10 intake sections 16 through the intake channel and the outlets 17, and exhaust working fluid flows from the rotary valve 10 exhaust sections to the external energy source through the exhaust channel 18 and the inlets 19, furthermore, working fluids equalize between communicating sections in respective channels, which optimizes distribution of working fluid to the rotary valves and thus the piston chambers. The pipe 15 additionally provides pivotal support of the rotary valves 10, especially through a series of annular bearings integrated with the section walls, and may include multiple intake channels 16 and multiple exhaust channels 18 for a rotary valve design having radially separated intake sections 11 and exhaust sections 13, and may be fixed and not attached to the rotary valves 10 or rotatable and attached to the rotary valves 10. The engine includes an output shaft 9 to which the crankshafts 5 merge motive power, preferably by the means of a pulley system. The pulley system includes a crank pulley 6 attached to each crankshaft 5, an output shaft pulley 8 attached to output shaft 9, and pulley belts 7 or pulley chains tensioned between the crank pulleys 6 and the output shaft pulley 8. The rotary valves 10 may use this pulley system to receive motive power, specifically if the rotary valves are linearly linked together as a single unit with shared timing, the rotary valve 10 with the closest proximity to the pulley system may connect to the output shaft pulley 8 directly as illustrated, or through a small gearbox.

Referring to FIG. 5-FIG. 8, a rotary valve subassembly of the engine is shown where the pipe 15 is a fixed component and features annular pipe bearings 20 along the circumference that fit against the rotary valves 10, the bearings providing pivotal support for the rotation of the rotary valves 10 around the pipe 15. The pipe bearings 20 also double as seals that prevent leakage of working fluids between gaps that would otherwise be present along the contact surfaces of the rotary valves 10 and the pipe 15. The rotary valves 10 also includes annular rotary valve bearings 22 along the rotary valve circumference, which fit against the housing body 21 and also provide pivotal support for rotation. The rotary valve bearings 22, which may be of any bearing type, also double as seals that prevent leakage of working fluids between gaps that would otherwise be present along the contact surfaces of the rotary valves 10 and the housing body 21. Both sets of bearings allow movement of the rotary valves 10 against both the housing body and the pipe 15 with reduced friction, but other alternatives to this approach may be considered. The rotary valves 10 may be of any shape with accordingly unique surfacing, in the illustrations the rotary valves are cylindrical, but they may also be double torus or spherical, for example. The cylindrical shape of the rotary valves 10; however, allows for the plurality of rotary valves 10 to be inserted axially from a single side of the housing body 21 and enables the central part of the housing to be a unitary component. Further, the engine should include adequate lubrication means, cooling means, and sealing means to maintain ideal engine operation.

Figure 9:
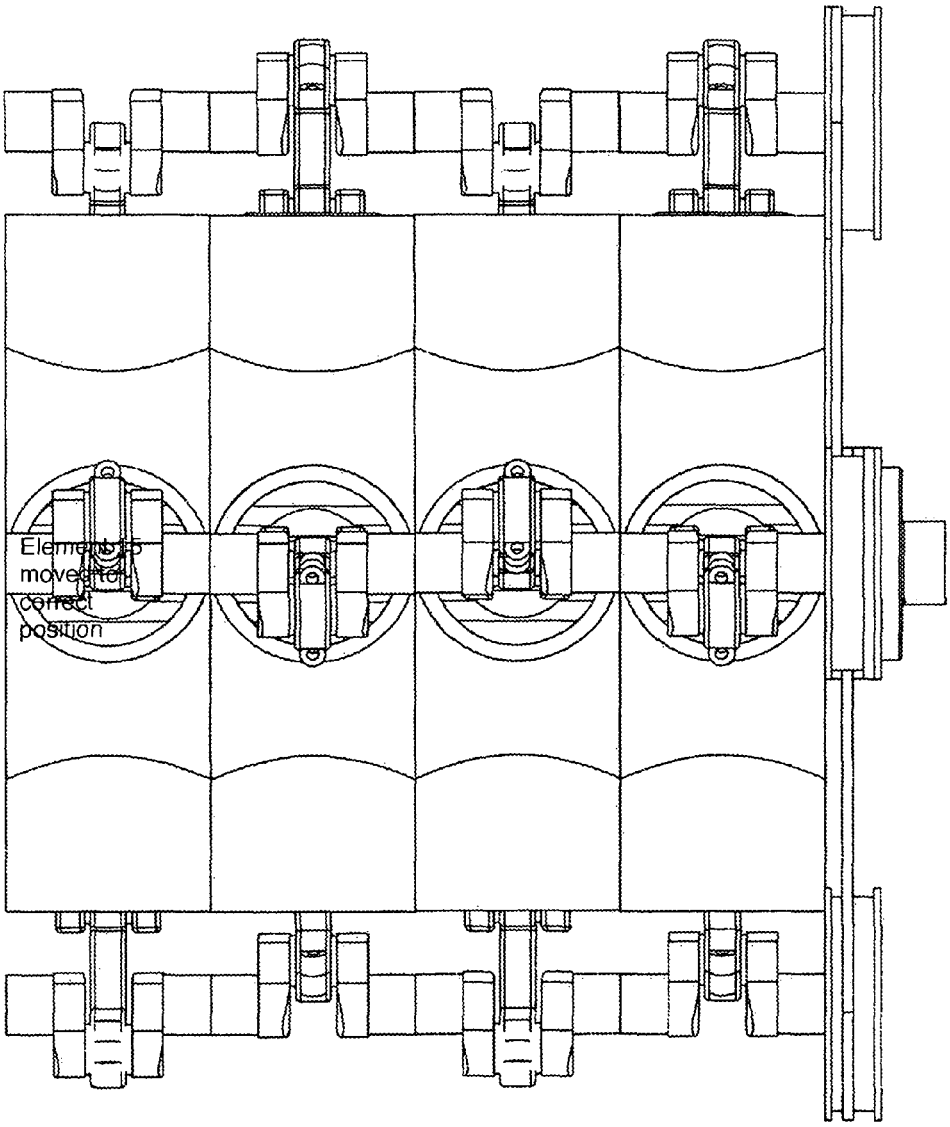
FIG. 9 is a side view of an engine assembly with multiple collinear rotary valve subassemblies paired.
Figure 10:
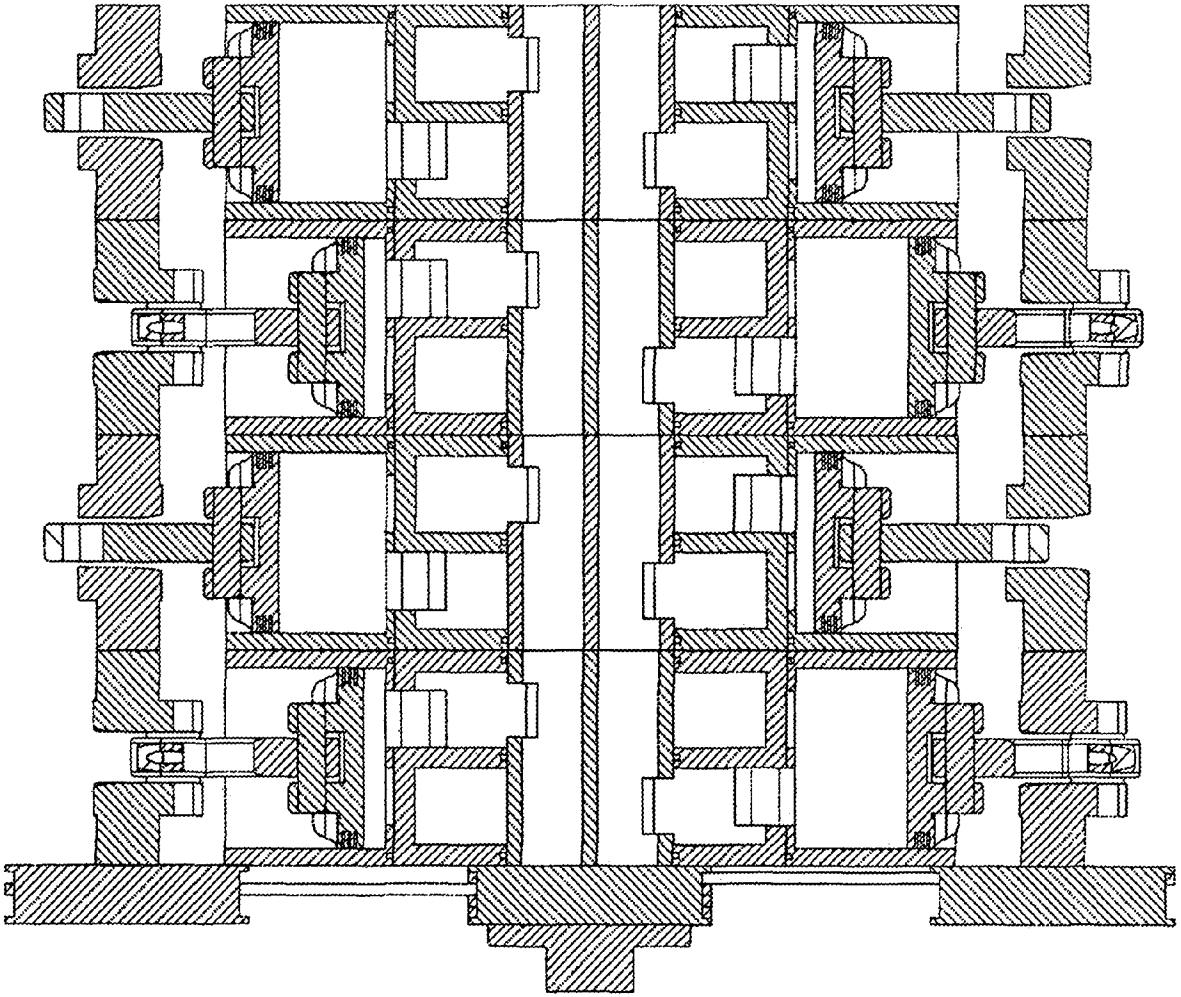
FIG. 10 is a side view of an engine assembly with multiple collinear rotary valves paired sectioned mid-plane and emphasis on the connection between the inner workings.

Referring to FIG. 9-FIG. 10, the preferred embodiment of the final assembled engine is shown here with a plurality of rotary valve subassemblies linearly arranged and connected together, showing in particular, multiple rotary valves 10 linearly arranged and seamless merging of crankshaft 5 segments between radially aligned cylinders 23 to form crankshafts 5 having multiple pistons 1, and particularly in FIG. 10, the extension of the pipe 15 through all the rotary valves 10 in which the intake channel 16 has an outlet 17 per rotary valve intake section 12 and the exhaust channel 18 has an inlet 19 per rotary valve exhaust section 14. Additionally, the linking of the rotary valves 10 together to receive motive power from the output shaft 9, and the seamless integration of the core segments of the housing body 21. The preferred embodiment of the engine here is to be understood as complete in its simplest terms. The many aspects of this engine design essence here are to be contemplated within the core scope of the invention, including, the number of pistons 1 radially disposed to each rotary valve 10, the radial spacing of the pistons 1 around each rotary valve 10 including if the positioning of multiple pistons is biased to particular sides, and the quantity of rotary 10 valves linearly arranged. Other possibilities to be contemplated include the layout of the crankpin journals on the crankshafts 5 and the corresponding offsets between the rotary valves 10. In the present example, four rotary valves 10 are present, four pistons 1 are radially disposed to each rotary valve 10, the pistons 1 are spaced evenly ninety degrees apart, the crankshaft 5 has one hundred and eighty degree crankpin journal offsets corresponding with one hundred and eighty degree rotary valve 10 offsets, and the rotary valves 10 are linked together to receive motive power from the output shaft 9. Further aspects of the engine to be considered may include the displacement of the engine, the dimensions of the piston chambers, the orientation of the engine, and the stationary and transport applications to be considered for use.

The advantages present in this invention are numerous. Chiefly, the quantity of pistons and the combined displacement of their chambers that may be compacted in this design exceeds any other engine relative to its size. The quantity of rotary valves and pistons disposed to each rotary valve that may be contemplated provide great form factor when there are dimensional constraints. The direct delivery of the valve system through the pipe and the rotary valves allows for the piston chambers and external heated engine to be closer, which reduces heat loss each cycle and increases efficiency. The valve system is superior than those provided other external heated engines as intake and exhaust fluid delivery to the valves is continuous and there is no limit to the quantity of the pistons as there are no orifices in the housing between pistons needed to transfer fluid between the valves and the external energy source. Further, the array of crankshafts assist in balancing each other and the translation of power to the rotary valve operation from them. Lastly, the reduction of weight and size and large periphery systems should equate to an overall decrease in manufacturing and maintenance costs; as well as, an increase in fuel efficiency. It is necessary to note that any judgement of the scope of the present invention should reflect the claims first, and the description provided should not limit that scope.

I claim:

1. A reciprocating heat engine having cylinders and pistons therein defining a working body, wherein energy is supplied to the working body by the means of a heat conductive working fluid from an adapted heat producing external energy source, the reciprocating heat engine comprising:

a housing body that encloses and seats:

(a) a plurality of rotary valves linearly arranged, each rotary valve formed having at least one intake section and at least one exhaust section for the respective intake and exhaust of working fluid through corresponding intake and exhaust apertures axially pitched about the rotary valve body circumference;

(b) a plurality of inwardly facing radially disposed to each rotary valve, wherein said pistons are radially aligned between said rotary valves and disposed to reciprocate perpendicular to the rotary valve axis of rotation;

(c) fixed cylinders enclosing each of said pistons, each of said cylinders having at least one port thereon to communicate working fluid with said rotary valves by intersection of said intake and exhaust apertures, said fixed cylinders between said rotary valves being radially aligned with said pistons;

(d) a plurality of crankshafts, each of said crankshafts longitudinally united to a single radial alignment of cylinders and mated to said pistons therein, wherein each of said crankshafts rotate in response to movement of the pistons; and (e) a slotted channeled tube extending axially through a central portion of all the rotary valves, said slotted channeled tube including:

(1) at least one intake fluid channel occupying a longitudinal portion of the tube interior, each of said intake fluid channels having an open circumferential outlet per contacting intake section of each rotary valve and at least one end opening through which the external energy source supplies working fluid, wherein each of said outlets provide a passage into a respective intake section volume, whereby intake fluid flows from the external energy source to the intake sections of all the rotary valves through the intake fluid channel; and (2) at least one exhaust fluid channel occupying a separate longitudinal portion of the tube interior, each of said exhaust fluid channels having an open circumferential inlet per contacting exhaust section of each rotary valve and at least one end opening through which the external energy source receives working fluid, wherein each of said inlets provide a passage into a respective exhaust section volume, whereby exhaust working fluid flows from the rotary valves to the external energy source through the exhaust channel.

2. The engine as set forth in claim 1, further comprising a common output shaft to which the crankshafts merge motive power.

3. The engine as set forth in claim 2, wherein the rotary valves are connected together forming a subassembly and receive motive power linearly from the output shaft.

4. The engine as set forth in claim 1, wherein each rotary valve is formed having an intake section and exhaust section separate about two segments of the rotary valve length.

5. The engine as set forth in claim 1, wherein the rotary valves have rotatory offsets to each other corresponding with the crankpin journal layout of the crankshafts and dependent piston positioning.

* * * * *